US007565921B2

(12) United States Patent
Roy

(10) Patent No.: US 7,565,921 B2
(45) Date of Patent: Jul. 28, 2009

(54) LOG FEED ROLL AND FLUTE ATTACHMENT

(75) Inventor: Dany Roy, Saint-Arthur (CA)

(73) Assignee: Johnson Enterprises Inc., Van d'Amour, N.B. (CA)

( * ) Notice: Subject to any disclaimer, the term of this patent is extended or adjusted under 35 U.S.C. 154(b) by 336 days.

(21) Appl. No.: 11/603,023

(22) Filed: Nov. 22, 2006

(65) Prior Publication Data

US 2008/0115859 A1 May 22, 2008

(51) Int. Cl.
*B27B 31/00* (2006.01)
*B27B 25/02* (2006.01)

(52) U.S. Cl. ..... 144/246.1; 144/248.7; 198/780; 492/31; 492/33; 492/38

(58) Field of Classification Search ..... 144/242.1, 144/246.1, 248.2, 248.3, 248.5–248.7, 250.1; 198/624, 692, 780; 492/30, 31, 33–36, 38
See application file for complete search history.

(56) References Cited

U.S. PATENT DOCUMENTS 2,850,853 A * 9/1958 Simendinger ..... 451/303
4,385,650 A * 5/1983 Schmidt ..... 144/248.7
4,901,778 A * 2/1990 Fenton ..... 144/230
6,253,813 B1 7/2001 Kube et al.
6,394,259 B1 * 5/2002 Alhainen ..... 198/692
6,422,277 B1 7/2002 Kube et al.
6,453,959 B1 9/2002 Johnson et al.
6,481,471 B1 11/2002 Johnson et al.
6,684,923 B1 * 2/2004 Isley ..... 144/248.7

* cited by examiner

*Primary Examiner*—Shelley Self
(74) *Attorney, Agent, or Firm*—Equinox Protection; Franz Bonsang, Patent Agent

(57) ABSTRACT

A log feed roll for displacing a log has a roll which may be rotated around a rotary axis, flutes for propelling the log, and removable flute attachments fastened to the flutes for contacting the log during engagement of the log in the feed roll. The flutes have flute apertures extending through side walls thereof. The attachments have a top attachment section from which generally opposed side braces extend. The attachments are fastened to the flutes by bolts extending through the brace apertures on one side brace, the flute apertures and the brace apertures on the opposing side brace, and nuts engaged on the bolts on the opposing side brace. The side walls are situated between the side braces, in abutment therewith when the attachment is fastened to the flute.

22 Claims, 5 Drawing Sheets

LOG FEED ROLL AND FLUTE ATTACHMENT

FIELD OF THE INVENTION

The present invention relates to a feed roll, and more particularly to a feed roll for displacing a log of wood and a flute attachment for the feed roll.

BACKGROUND OF THE INVENTION

It is well known in the art to use feed rolls in the process of debarking, i.e. removing bark, from logs. Typically, such feed rolls are driven, by a motor or the like, and are situated at the input and output of debarkers for driving the logs through the debarker. Generally, two sets of flutes, each flute of one set having a corresponding flute on the other set with the corresponding flutes converging at inner portions thereof towards a central portion of the roll, are shaped to provide a recess in which the logs are supported and to grip and propel the logs through the debarker by rotation of the roll. As the log is generally supported and gripped through the inner portions, it is these portions that must provide most of the support and traction for advancing the log. Accordingly, these inner sections often have gripping members for gripping the log. At the same time, since the inner portions provide most of the support and traction, it is these inner portions, including the gripping members, that are most susceptible to wear and tear. Thus, the inner portions, and sometimes the entire flutes, must, eventually, be replaced. In traditional feed rolls, this necessitates removing the entire roll for replacing the flutes or inner sections thereof, which is, obviously, time consuming and inefficient, especially since the flutes are typically welded to the roll.

One solution for facilitating replacement and repair of flutes is to provide flutes for which at least a portion, and notably the inner flute portion which supports and grips the logs, are replaceable. For example, U.S. Pat. No. 6,253,813 issued to Kube et al. on Jul. 3, 2001 provides a feed roll in which there are removable flute attachments which are removably fastened on one side wall of the inner portions of the flutes and which have gripping members extending thereabove.

The flute attachments are attached with screws which extend through apertures in the flute attachment into threaded flute apertures, i.e. sockets, which extend through the inner portion of the flute. Thus, the attachments support and grip the log, which reduces wear and tear on the inner portions and then are simply moved and replaced when the attachments become worn. However, as the attachments are only attached on one side of the inner portions, the stress on the side to which the attachments are attached is disproportionate to that on the opposing side. Further, while the screws in Kube et al. are adapted for extending precisely through the inner portion of the flute to the side wall opposite the side wall to which the attachment is attached, this leaves little support for holding the attachment in place on the side wall opposite to the side wall to which the flute is attached. Thus the screws undergo great stresses and become a weak point of the design. Finally, as the attachment is mounted and extends alongside the inner flute portion in Kube, as opposed to covering the top of the inner flute portion, the configuration taught in Kube offers little protection for the top of the flute and the inner flute end, i.e. the end of the flute closest to the centre of the roll.

Accordingly, there is a need for an improved feed roll with replaceable flute attachments that obviates the difficulties described above.

SUMMARY OF THE INVENTION

It is therefore a general object of the present invention to provide an improved feed roll for a log with a removable attachment therefor.

An advantage of the present invention is that the attachments provide protection for the top portions of the flutes.

Another advantage of the present invention is that the attachments provide protection for both side walls of each flute.

A further advantage of the present invention is that the attachments provide additional protection for the inner flute ends of the flutes with intersection sections thereof that extend partially over the corresponding intersecting inner flute end for enhanced traction for the log L at the inner flute ends as well as enhanced protection of the inner flute ends, which allows, in turn, for improved or increased traction for logs L that are smaller in circumference than that provided by prior art rolls.

Yet another advantage of the present invention is that the attachments provide for a stronger interface, due to the attachment design that provides for a stable 'sitting' position thereof on the flute, with the flutes that makes the securing screws aside from the main operation load path acting on the flutes.

In a first aspect of the present invention, there is provided a feed roll for displacing a log, comprising:

a roll having a rotary axis;

generally opposed first and second sets of flutes, for propelling the log, attached to the roll on an outer surface thereof, the flutes within each set being axially spaced apart relative one another and having generally opposed side walls extending across the outer surface between generally opposed inner and outer flute ends thereof, and for each flute, a removable flute attachment having a top attachment section and generally opposed side braces extending therealong and away therefrom, the side braces having at least one pair of axially aligned brace apertures and the side walls having at least one flute aperture extending therebetween, the removable flute attachment being adapted for removable attachment to the flute with the top attachment section extending thereover and with the side braces in contacting engagement with the side walls and with the brace apertures and the flute aperture in registered relationship for axial insertion of a fastening means therethrough for releasably fastening the flute attachment on the flute for contacting the log.

In a second aspect of the present invention, there is provided a removable flute attachment for a feed roll for a log, the feed roll having a rotary axis and at least one flute on an outer surface thereof, the flute having generally opposed side walls with at least one pair of axially aligned flute apertures extending through the side walls, the flute attachment comprising a top flute section and side braces extending from the top flute section generally away therefrom, each side brace having at least one brace aperture adapted, when in registered relationship with the flute aperture, for axial removable insertion of a fastening means therethrough for releasably fastening the flute attachment on the flute with the side braces in abutment with the side walls.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

Figure 1:
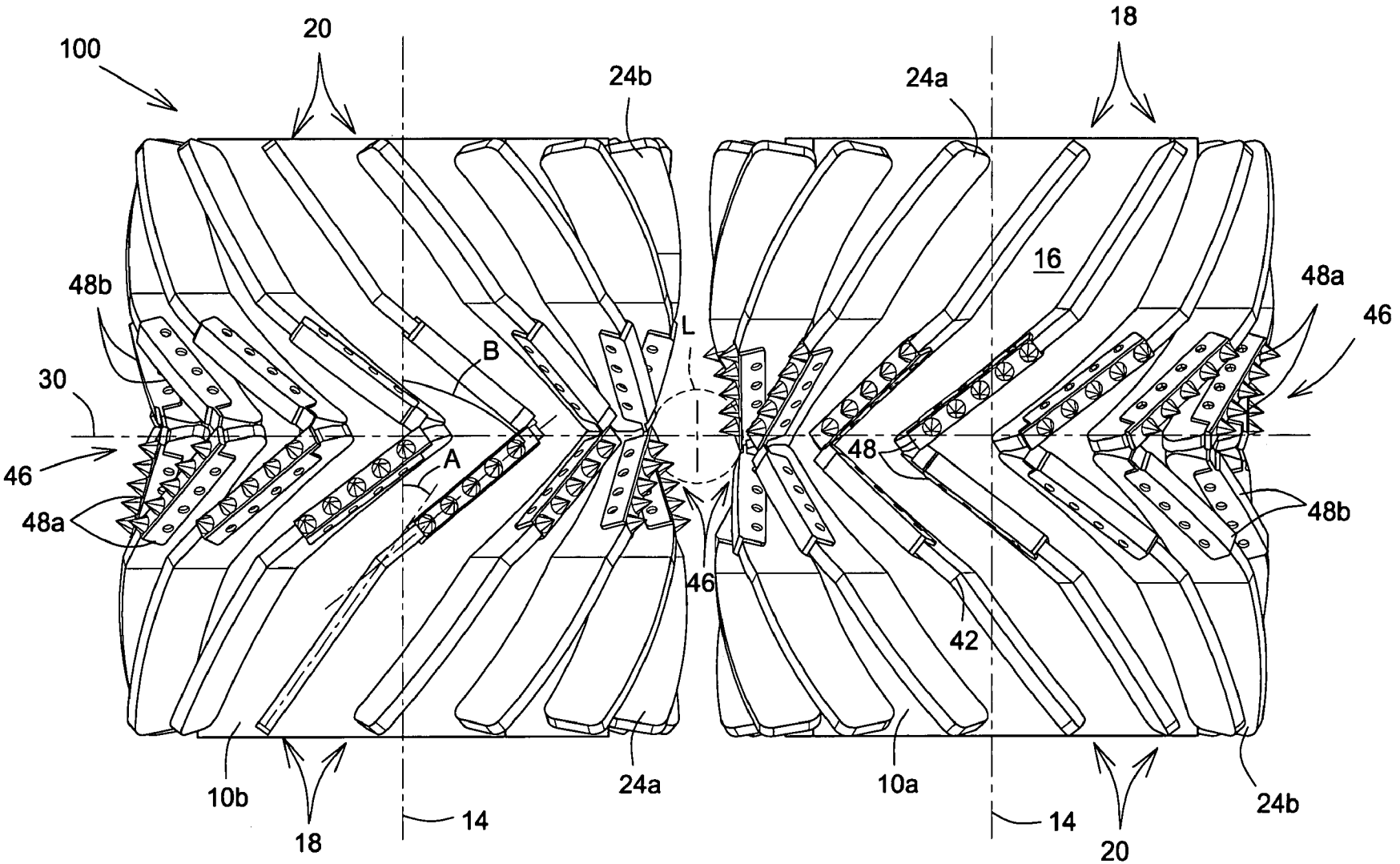
FIG. 1 is a front view of a feed roll, having replaceable flute attachments, for displacing a log in accordance with an embodiment of the present invention.

Reference is now made to FIG. 1, which shows a feed roll 10, for displacing a log L. Typically, the feed roll 10 is deployed for displacing the log L towards, or away from, a debarker, not shown. However, the feed roll may be used to feed a log L towards, or away from, any implement, machine, or instrument for performing an operation on the log L.

The feed roll 10 is a, preferably cylindrical, roll 10 having a rotary axis 14 around which the roll 10 can be rotated either by hand or by a motor or the like. The roll 10 is typically made out of a sturdy metal, such as iron, steel, or the like. The roll 10 has an outer surface 16 upon which, preferably, generally opposed first and second sets, shown generally as 18 and 20 of flutes 24, are securely attached. The flutes 24 engage, i.e. support and grip, the log L while on the roll 10 to guide and propel the log to and from the debarker, not shown, depending on whether the roll 10 feeds the log L into the input of the debarker or receives the log L from the output of the debarker. Additionally, the flutes 24 facilitate separation of the log L from the outer surface 16 of the roll 10, which protects the roll 10 and the outer surface 16.

Referring now to FIGS. 1, 2, 3 and 4, each flute 24, preferably, consists of a single piece of sturdy metal, such as iron, steel, or the like, and is preferably attached to the outer surface 16 by welding. The respective flutes 24*a*, 24*b* of each respective set 18, 20 are axially spaced apart, relative axis 14, from, and preferably parallel to, the other flutes 24*a*, 24*b* in the same set 18, 20 on the outer surface 16 of the roll 10. Each flute 24 has a preferably rounded inner flute end 26, situated proximal a central position, shown by axis 30, on the outer surface 16, and a generally longitudinally opposed outer flute end 28, situated generally distal the central position 30 and proximal an outer edge 32 of the outer surface 16, between which generally opposed side walls 34 of the flute 24 longitudinally extend. Thus, the flutes 24*a*, 24*b* of the first and second sets 18, 20 extend from their outer flute ends 36, situated respectively proximal the first and second outer edges 32*a*, 32*b*, transversely across the outer surface 16 towards their inner flute ends 26 situated proximal the central position 30. Further, each flute 24 has an outer flute portion 36, situated proximal the outer flute end 28 and extending thereto, and an adjoining inner flute portion 38 situated proximal the inner flute end 26 and which extends to the outer flute portion 36. Each flute 24 also has a top flute portion 40, i.e. a top flute surface, which extends between the side walls 34 from the inner flute end 26 to the outer flute end 28, the side walls 34 themselves extending generally outwardly from the outer surface 16 to the top flute portion 40.

Each flute 24 from one set 18, 20 preferably has a corresponding flute 24 in the other set 18, 20. The outer flute ends 28 of each flute 24 and the corresponding flute 24, situated at opposing outer edges 32*a*, 32*b* are preferably circumferentially aligned with one another at substantially the same circumferential position on the roll 10, with their respective inner flute portions 38 converging toward one an other, and preferably intersecting one another at their respective inner flute ends 26 in proximity to the central position 30. Further, the outer flute portion 36 is, preferably, angled, i.e. slanted, relative the rotary axis 14 in an axial direction towards the central position 30, as schematically indicated by angle A in FIG. 1. The inner flute portion 38 is, at an intersecting point 42 between the portions 36, 38 and which defines the border therebetween, angled away from the axial direction at an angle B greater than that, angle A, of the outer flute portion 38. In other words, the flutes 24 are slanted, relative the rotary axis 14, towards the central position 30 with the inner flute portion 38 of the flute 24 being slanted, at the intersecting point 42, more steeply towards the central position 30 than the outer flute portion 36. Thus, each flute 24*a* and its corresponding flute 24*b* are, together, attached to the outer surface 16 in a V-shaped configuration, shown generally as 44, extending from the outer flute ends 28 thereof towards the inner flute ends 26 where the flutes 24 converge and preferably intersect, preferably with the side wall 34 of one flute 24*a* extending at least partially across the inner flute end 26 of the corresponding flute 24*b*. Typically, the inner flute ends 26, preferably intersecting, point towards, and are aligned with, the input or output of the debarker to direct the log L, respectively, towards the input or away from the output.

Figure 2:
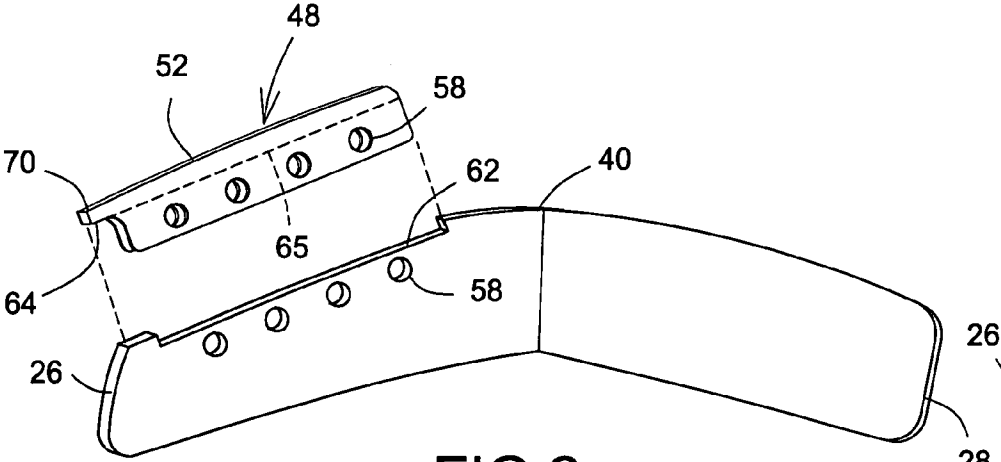
FIG. 2 is a side view of a flute for the feed roll shown in FIG. 1.
Figure 4:
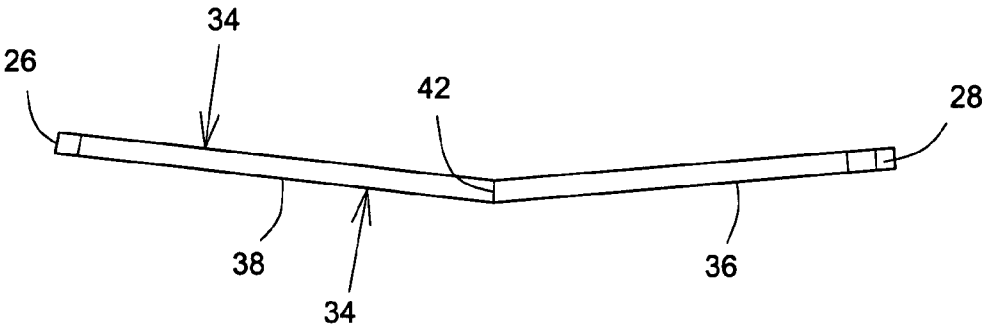
FIG. 4 is a top view of a flute for the feed roll shown in FIG. 1.

Additionally, and as best shown in FIGS. 1 and 2, the respective inner flute portion 38 of each flute 24 is tapered inwardly, i.e. inclined, towards the outer surface 16 as it extends to the inner flute end 26. Thus, when their respective inner flute ends 26 intersect, each flute 24 and corresponding flute 24 together form a log recess, shown generally as 46, in which the respective inner portions 38, and notably the top flute portions 40 thereof, taper, i.e. incline, towards the outer surface 16 to the intersecting inner flute ends 26 thereof in proximity to the central position 30. The log L, or a portion thereof, is preferably situated in the log recess 46 to further guide the log L towards the debarker. Optionally, the outer flute portions 36 may also be tapered, i.e. inclined, towards the outer surface 16, preferably at a lower degree of incline, however, than the inner flute portions 38.

Figure 3:
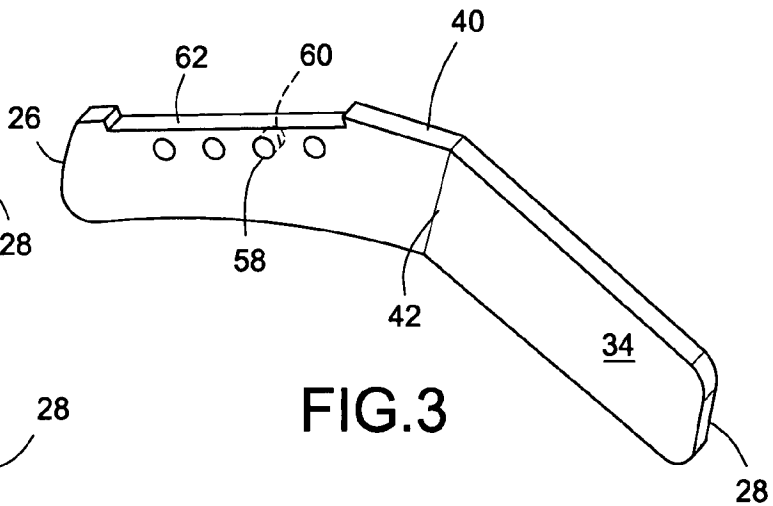
FIG. 3 is a front perspective view of a flute for the feed roll shown in FIG. 1.
Figure 5:
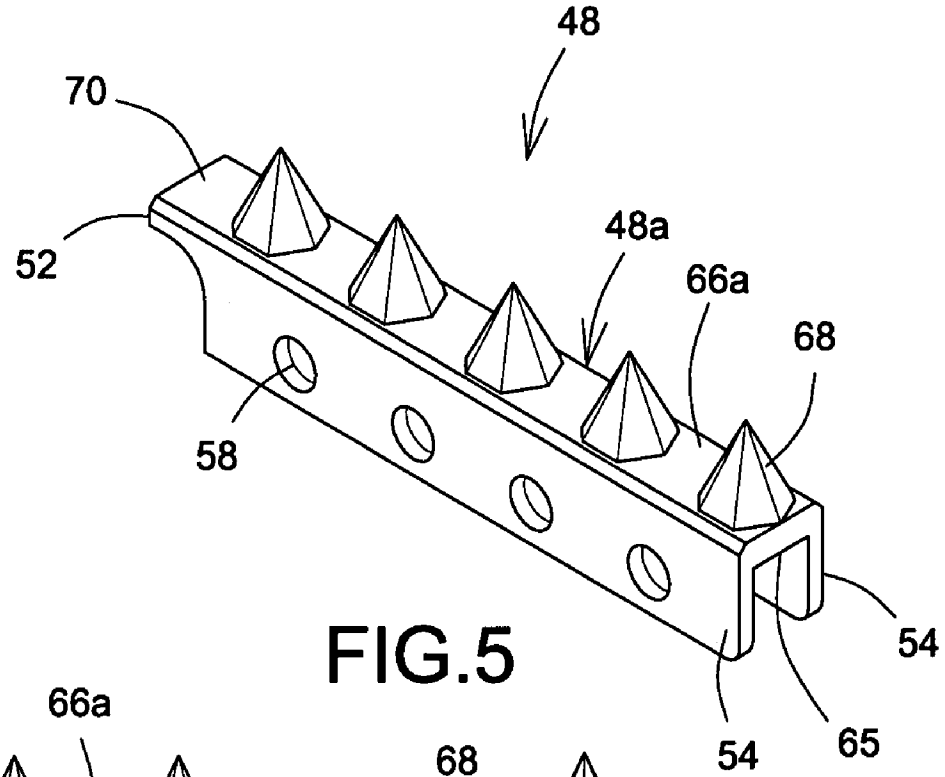
FIG. 5 is a perspective view of view of a removable flute attachment for the feed roll of FIG. 1.
Figure 7:
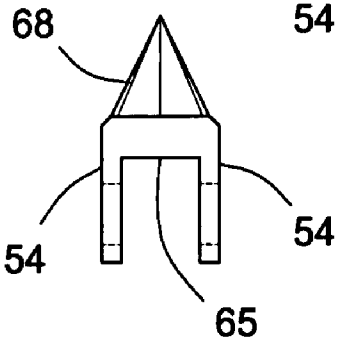
FIG. 7 is a front plan view of the removable attachment shown in FIG. 5.
Figure 8:
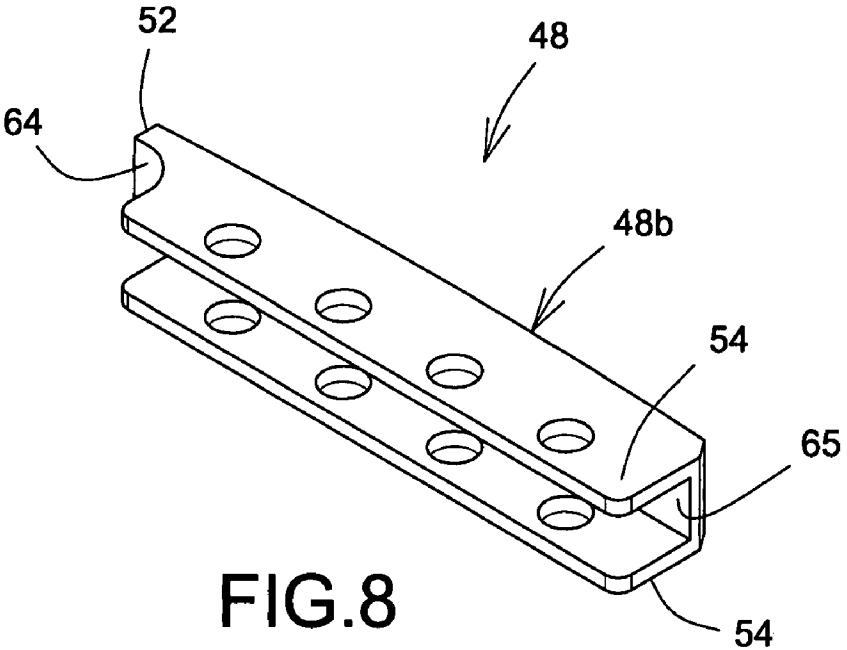
FIG. 8 is a perspective view of view of another removable flute attachment for the feed roll of FIG. 1.

Reference is now made to FIGS. 1-3 and 5-10. At least one, and preferably all, of the flutes 24 have a removable flute attachment 48 removably fastened, i.e. mounted, thereupon with a fastening means, preferably on the inner flute portion 38 of each flute 24. As best shown in FIGS. 5 and 8, each flute attachment 48 for each flute 24 has a top attachment section 52 and generally opposed side braces 54 extending at least partially alongside the top attachment section 52 and away therefrom. The side braces 54 have at least one pair, and preferably a plurality of pairs, of axially aligned brace apertures 56 on opposing side braces 54. As shown in FIGS. 2 and 3, the side walls 34 of each flute 24 have, for each pair of brace apertures 56, a corresponding pair of axially aligned flute apertures 58 for each pair of brace apertures 56, defining a corresponding flute channel 60 extending through the flute 24 from one side wall 34 to the opposing side wall 34 thereof.

Figure 6:
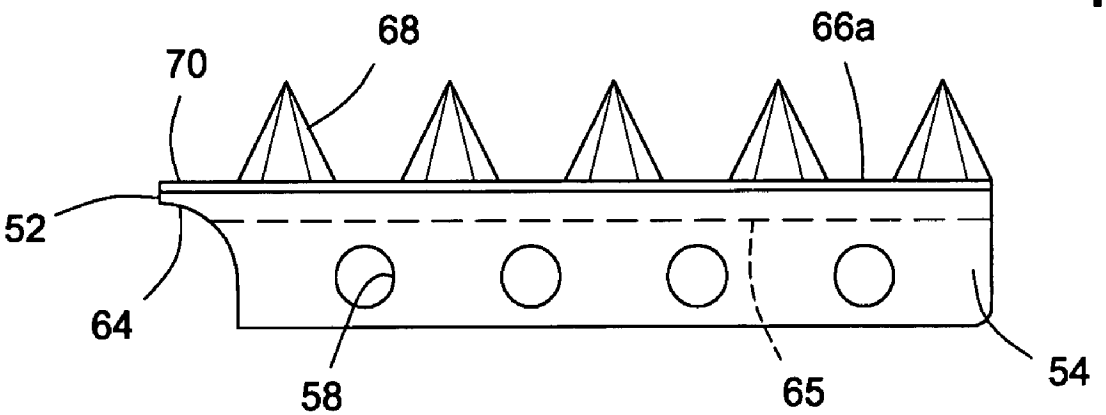
FIG. 6 is a side plan view the removable attachment shown in FIG. 5.
Figure 10:
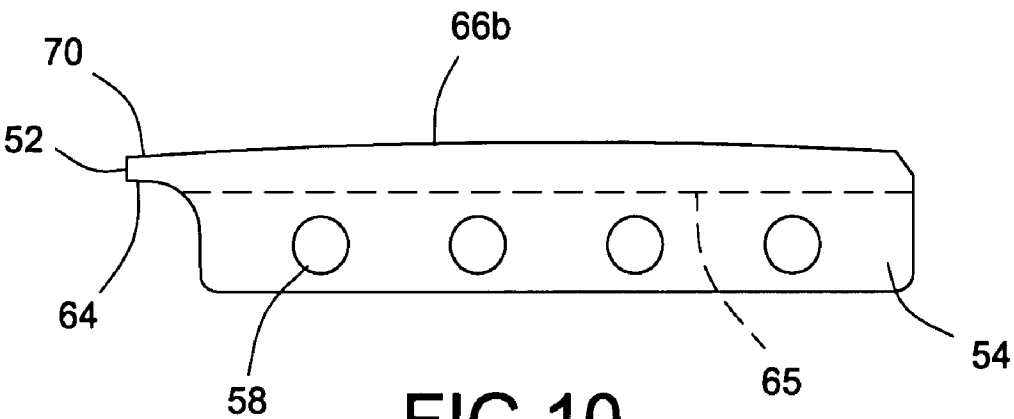
FIG. 10 is a side plan view the removable attachment shown in FIG. 5.
Figure 9:
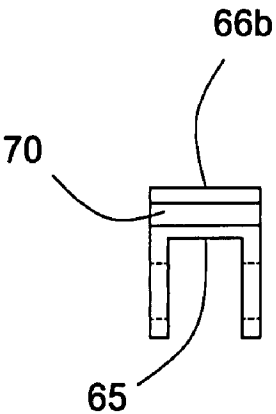
FIG. 9 is a front plan view of the removable attachment shown in FIG. 5.

Referring now to FIGS. 5 through 7, the top attachment section 52 for each attachment 48 has a log engagement side 66 which, when the attachment 48 is fastened to the flute 24, faces away from the outer surface 16 and towards the log L for contacting the log L. As shown, for attachment 48*a*, the log engagement side 66*a* may have gripping members 68 protruding outwardly away therefrom, in a direction generally opposite that from which the side braces 54 protrude from the top attachment section 52, for protruding into and gripping the log L to provide additional traction for driving the log towards or away from the debarker. The gripping members 68 are, preferably, teeth or spikes. However, any other gripping member 68 capable of gripping log may be deployed. As shown in FIGS. 8-10, the log engagement section 66*b* may, instead of having gripping members 68, be substantially planar and smooth, as shown for attachments 48*b*. Gripping members 68, and attachments 48, are, preferably, made out of a strong and resistant metal, such as iron, steel, or the like. Preferably, but optionally, one set 24*a* of flutes 24 will have attachments 48*a* with gripping members 68, whereas the flutes 24 of the other set 24*b* will not have gripping members 68 and will have top attachment sections 52, notably log engagement sections 66*b* thereof, that are planar and smooth.

Reference is now made to FIGS. 2, 3, 11, and 12. The apertures 56, 58, and channel 60 are configured, i.e. positioned sized and shaped, such that, when each pair of brace apertures 56 is in registered relationship, i.e. axially aligned, with the respective corresponding flute apertures 58 therefor, a fastening means may be axially inserted through the apertures 56, 58 and channel for removably and securely fastening the attachment 48 to the flute 24. At the same time, side walls 34 and side braces 54 are configured such that when the attachment 48 is fastened with fastening means to flute 24, the side braces 54 extend at least partially alongside side walls 34, preferably on the inner flute portion 38, in abutment therewith. Similarly, top attachment section 52 and top flute portion 40 are configured such that, when the attachment 48 is fastened with fastening means to flute 24, a mating side 64 of top attachment section 52, situated generally opposite the log engagement side 66, extends, preferably on the inner flute portion 38, over at least a portion of the top flute portion 40 in abutment therewith.

Reference is now made to FIGS. 1, 2, 3, 6, 8, 11, and 12. To further assist in placement of the attachment 48 on the flute 24 with brace apertures 56 aligned in registered relationship with their corresponding flute apertures 58, the top flute portion 40 has a recessed portion 62 extending therein towards the outer surface 16 and the mating side 64 of the top attachment section 52 has a mating section 65 which protrudes slightly outwardly between the side braces 54 relative the remainder of the mating side. The mating section 65 and recessed portion 62 are configured such that, when with brace apertures 56 aligned in registered relationship with their corresponding flute apertures 58, the mating section 65 extends into the recessed portion 62 and abuts the top flute portion 40 therein, thus matingly engaging the top flute portion 40 in the recessed portion 62 thereof. Preferably, the top attachment section 52 also has an end section 70, such as a lip or flange, which extends outwardly beyond the side braces 54 and which is situated extending partially over the inner flute end 26 when the attachment 48 is fastened to the flute 24. The end sections 70 are, preferably, configured such that the end sections 70 of attachments 48 on corresponding flutes 24 intersect with one another with one end section 70 extending at least partially over the other in abutment therewith. The end section 70 may, if desired, have a gripping member 68 protruding therefrom, thus insuring that the additional grip and traction provided thereby is available even in proximity to the innermost, i.e. most central relative to the roll 10, portion of the flute 24. Thus, the end sections 70 partially cover the inner flute ends 26, which typically undergo the greatest stress and contact with the log L during use, and therefore reduce wear and tear on the inner flute ends 26. The fact that the inner flute ends 26 are curved on an incline towards the outer surface 16 further reduces contact between the inner flute ends 26 and the log L and increases longevity of the flutes 24.

Figures 11, 12:
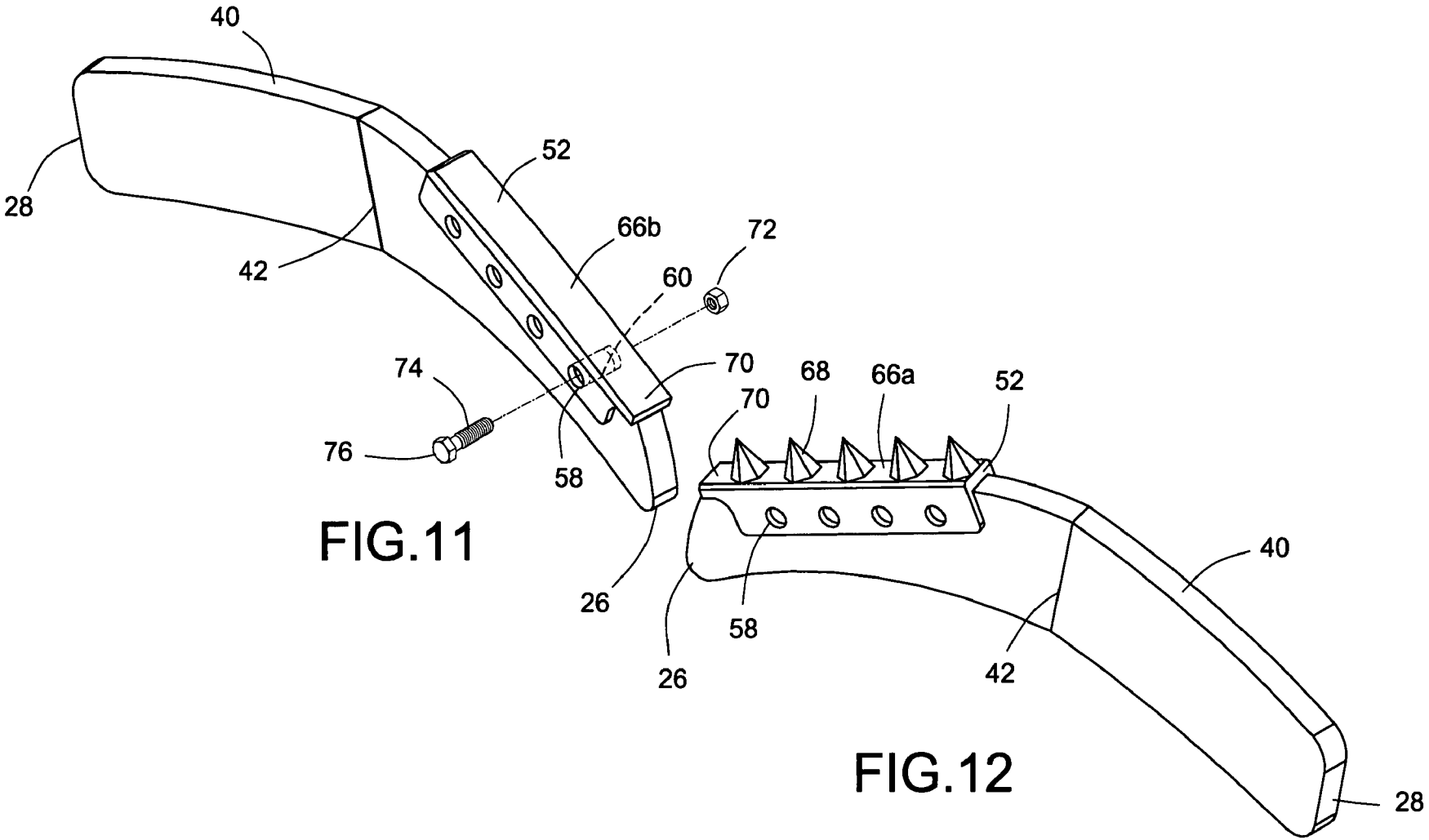
FIG. 11 is a front perspective view of a flute for the feed roll shown in FIG. 1 with the removable flute attachment shown in FIG. 8 placed thereon.
FIG. 12 is a front perspective view of a flute for the feed roll shown in FIG. 1 with the removable flute attachment shown in FIG. 5 placed thereon.

Reference is now made to FIGS. 2, 3, and 11. As best illustrated in FIG. 11, for each set of brace apertures 56 and corresponding set of flute apertures 58 and channel 60, the fastening means is, preferably, a threaded nut 72 and threaded bolt 74. The apertures 56, 58, channel 60, and bolt 74 are configured for axial insertion and extension of the bolt 74 through the brace apertures 56, flute apertures 58, and channel 60, with the head 76 of the bolt 74 in contacting engagement with one of the side braces 54. The nut 72 is engaged, i.e. screwed on, to the bolt 74 on the opposing side brace 54 in abutting contact therewith to immobilize the attachment 48 on the flute 24. Thus, the nut 72 and bolt 74 tightly and securely retain the attachment 48 on the flute 24. The nut 72 can be subsequently disengaged, i.e. unscrewed, and the bolt 74 removed. When all of the nuts 72 and bolts 74 for the apertures 56, 58 of a given flute 24 and attachment 48 therefor have been removed, the attachment 48 can be removed and replaced. It should be noted that any other fastening means that can be axially inserted and removed through the apertures 56, 58 and channel 60 for securely fastening and immobilizing the attachment 48 on the flute 24 may be deployed. For example, a member could be axially inserted through apertures 56, 58, and channel 60 and then nuts or other securing means could be engaged on opposing ends of the member in abutting engagement with the side braces 52 to hold and immobilize the attachment 48 on the flute 24.

Referring again to FIG. 1, as the attachments 48 are placed on the inner flute portions 38 of the flutes 24 of the two sets 24*a*, 24*b*, they are advantageously situated in the log recess 46 and form part of the V-shaped configuration 44. Accordingly, the attachments 48 cover the portion of the flutes 24 which have the most contact with, and receive the most stress from, the log L. Thus, the attachments 48 protect the flutes 24 from wear and tear and increase the lifespan of the flutes 24 and the roll 10. At the same time, the attachments 48, especially attachments 48*a* having gripping members 68, also provide traction for moving the log L towards and away from the debarker. In particular, as the attachments 48, i.e. intersection sections 70 thereof, extend partially over the intersecting inner flute ends 26 of the corresponding flutes 24 of the sets

18, 20, the attachments 48 provide both enhanced traction for the log L at the inner flute ends 26, as well as enhanced protection of the inner flute ends 26. This provision of traction at the inner flute ends 26 allows, in turn, for, improved, i.e. increased traction for logs L that are smaller in circumference than that provided by prior art rolls 24 having attachments for which the which gripping members 66 extend from alongside the side walls 34 above the top flute portions 40 of flutes 24. As stated previously, when the attachments 48 become worn, they may simply be unfastened by removing the fastening means and replaced.

Further, and advantageously, since the side braces 54 extend on both side walls 34 of the flute 24, both side walls 34, as opposed to rolls for which the attachment 48 only covers a single side wall 34, are protected. Further, the presence of the side brace 54 along each side wall 34, separating the head 76 of the bolt 74 and the nut 72 from the side wall 34, prevents direct contact between the nut 72 and head 74 and the side wall 34, further reducing wear and tear on the side wall 34, and thereby on the flute 24. Additionally, the fastening of the bolt 72 with the head 76 and the nut 72 securing the bolt 74 on opposing side braces 54 favors an even distribution of stress between the side walls 34 and side braces 54.

Referring again to FIG. 1, two rolls 10 may be advantageously combined to form a log feeding system, shown generally as 100, to feed the log L to or from a debarker or other equipment for cutting or treating the log L. As shown, the system 100 consists of first and second rolls 10*a*, 10*b*. The flutes 24*a* of the respective first set 18 for each roll 10 have attachments 48*a* with log engagement sides 66*a* of top attachment sections 52 having gripping members 68. The flutes 24*b* of the respective second set 20 of each roll 10 have attachments 48*b* with smooth and planar log engagement sides 66*a* on the top attachment sections 52 thereof. The rolls 10 are positioned spaced apart, preferably vertically, one other, preferably with their central positions 30 aligned with one another and with sufficient space between the rolls 10*a*, 10*b* for engagement of the log L by attachments 48 on the inner flute portions 38 of the rolls 10*a*, 10*b*. Their respective flutes 24 for the rolls 10*a*, 10*b* face one another, with the first set 18 of flutes 24 on the first and second rolls 10*a*, 10*b* positioned in axial alignment, relative the central position 30, with the second set 20 of flutes on the rolls 10*a*, 10*b*. Accordingly, the first sets 18 of flutes 24 on each roll 10*a*, 10*b* are situated facing directly towards the second set 20 of flutes on the other roll 10*a*, 10*b*. Thus, there is an attachment 48*a* having gripping members 68 on opposing sides of the log L when the log L passes between the rolls 10*a*, 10*b*, assuring adequate traction for the log L. At the same time as the attachments 48*b* facing the attachments 48*a* having the gripping members do not have gripping members 68 extending therefrom, the rolls 10*a*, 10*b* may be placed closely together, thus permitting feeding of smaller logs L, without having to align the rolls 10*a*, 10*b* or attachments 48 to avoid abutment between gripping members 68 on the rolls 10*a*, 10*b*.

While a specific embodiment has been described, those skilled in the art will recognize many alterations that could be made within the spirit of the invention, which is defined solely according to the following claims.

I claim:

1. A feed roll for displacing a log, comprising:

a roll having a rotary axis;

generally opposed first and second sets of flutes, for propelling the log, attached to said roll on an outer surface thereof, said flutes within each set being axially spaced apart relative one another and having generally opposed side walls extending across said outer surface between generally opposed inner and outer flute ends thereof, and for each flute, a removable flute attachment having a top attachment section and generally opposed side braces extending therealong and away therefrom, said side braces having at least one pair of axially aligned brace apertures and said side walls having at least one flute aperture extending therebetween, said removable flute attachment being adapted for removable attachment to said flute with said top attachment section extending thereover and with said side braces in contacting engagement with said side walls and with said brace apertures and said flute aperture in registered relationship for axial insertion of a fastening means therethrough for releasably fastening said flute attachment on said flute for contacting the log.

2. The feed roll of claim 1, wherein each flute has an outer flute portion extending to said outer flute end and an inner flute portion extending from said outer flute portion to said inner flute end, said inner flute end being situated proximal a central position of said outer surface and said outer flute ends of said flutes in said first and second sets being situated, respectively, proximal generally opposed first and second outer edges of said outer surface, said flute apertures being situated on said inner portion with said attachment being mounted thereupon and extending at least partially thereover.

3. The feed roll of claim 2, wherein each flute attachment for said first set has at least one gripping member extending from said top attachment section in a direction generally opposite said side braces.

4. The feed roll of claim 3, wherein said top attachment section for each flute attachment for said second set is substantially planar and smooth.

5. The feed roll of claim 3, wherein said gripping member is a tooth protruding from said top attachment section.

6. The feed roll of claim 2, wherein, for each flute, said inner flute portion is axially angled away from an axial direction, relative said outer flute portion, towards said central position at an angle greater than that of said outer flute portion.

7. The feed roll of claim 2, wherein each flute in said first set has a corresponding said flute in said second set, said inner flute portion of said flute in said first set and said inner flute portion of said corresponding said flute in said second set converging toward one another.

8. The feed roll of claim 7, wherein said inner flute portion of said flute in said first set and said inner flute portion of said corresponding said flute in said second set intersect one another at said inner flute ends thereof.

9. The feed roll of claim 7 wherein, for each flute, said inner flute portion is axially angled away from an axial direction, relative said outer flute portion, towards said central position at an angle greater than that of said outer flute portion.

10. The feed roll of claim 1, wherein each flute has a top flute portion, extending between said side walls, said top attachment section and said top flute portion being configured for abutment with one another when said flute apertures and said brace apertures are in said registered relationship.

11. The feed roll of claim 10, wherein said top flute portion has a recessed portion extending therein towards said outer surface and said top attachment section having a mating section extending between said side braces, said recessed portion and said mating section being configured for mating of said mating section with said recessed portion, in abutment therewith, when said flute apertures and said brace apertures are in said registered relationship.

12. The feed roll of claim 2, wherein, for each flute, said inner flute portion thereof tapers inwardly towards said outer surface.

13. The feed roll of claim 1, wherein said fastening means comprises a nut and a bolt, said nut extending through said brace apertures and said flute aperture and being releasably retained therein with a head of said bolt in contacting engagement with a one said side brace and said nut in contacting engagement with an opposing said side brace.

14. The feed roll of claim 1, wherein each flute is comprised of a single piece of material.

15. The feed roll of claim 1, wherein said inner flute end of each flute is curved inwardly towards said outer surface.

16. The feed roll of claim 15, wherein said inner flute end extends beyond said attachment towards said central position.

17. The feed roll of claim 2, wherein, for each flute, said attachment has an end section extending from said top attachment section beyond said side braces, said end section extending partially over said inner flute end.

18. The feed roll of claim 6, wherein, for each flute, said attachment has an end section extending from said top attachment section beyond said side braces, said end section extending partially over said inner flute end and intersecting said end section on an other said flute attachment fastened to said corresponding said flute.

19. A removable flute attachment for a feed roll for a log, the feed roll having a rotary axis and at least one flute on an outer surface thereof, the flute having generally opposed side walls with at least one pair of axially aligned flute apertures extending through the side walls, said flute attachment comprising a top flute section and side braces extending from said top flute section generally away therefrom, each side brace having at least one brace aperture adapted, when in registered relationship with the flute aperture, for axial removable insertion of a fastening means therethrough for releasably fastening said flute attachment on the flute with said side braces in abutment with the side walls.

20. The flute attachment of claim 19, further comprising at least one gripping member adapted for gripping a log, said gripping member extending from said top flute section and generally oppositely away from said side braces.

21. The flute attachment of claim 19, wherein said top flute section is generally smooth.

22. The flute attachment of claim 20, wherein said gripping member is a tooth.

* * * * *